US006709060B1

(12) United States Patent
Su

(10) Patent No.: US 6,709,060 B1
(45) Date of Patent: Mar. 23, 2004

(54) CHAIR BACKREST

(76) Inventor: Tung-Hua Su, No. 6, Sec. 3, Bao Ta Road, Kuwi Jen Hsiang, Tainan Hsien (TW)

( * ) Notice: Subject to any disclaimer, the term of this patent is extended or adjusted under 35 U.S.C. 154(b) by 0 days.

(21) Appl. No.: 10/613,571

(22) Filed: Jul. 3, 2003

(51) Int. Cl.[7] ..... A47C 4/02
(52) U.S. Cl. ..... 297/440.2; 403/290
(58) Field of Search ..... 297/440.1, 440.2, 297/440.22; 403/289, 290, 344

(56) References Cited

U.S. PATENT DOCUMENTS 2,460,027 A * 1/1949 Nash ..... 297/295
2,794,660 A * 6/1957 D'Azzo ..... 403/344
4,830,435 A * 5/1989 Nemschoff et al. .... 297/440.22
5,018,789 A * 5/1991 Sheckells ..... 297/440.2
5,779,317 A * 7/1998 Neal ..... 297/440.2
6,116,692 A * 9/2000 Tarnay et al. ..... 297/440.2
6,305,750 B1 * 10/2001 Buono et al. ..... 297/440.2
6,312,184 B1 * 11/2001 Hoshino ..... 403/344

* cited by examiner

*Primary Examiner*—Peter R. Brown
(74) *Attorney, Agent, or Firm*—Charles E. Baxley

(57) ABSTRACT

A chair includes a backrest and a support frame. A plurality of engaging posts are formed on a peripheral portion of a rear side of the backrest, each engaging post having a groove and a transverse fixing hole. The support frame extends along the peripheral portion of the rear side of the backrest A connecting beam includes a first end fixed to a lower portion of the support frame and a second end fixed to the chassis. A plurality of connecting blocks are provided fixing the support frame to the rear side of the backrest. Each connecting block includes a sleeve portion through which the support frame extends. Each connecting block further includes an insertion portion engaged in the groove of the respective engaging post. A fastener is extended through the transverse fixing hole in the respective engaging post into the insertion portion of the respective connecting block.

3 Claims, 6 Drawing Sheets

CHAIR BACKREST

BACKGROUND OF THE INVENTION

1. Field of the Invention

The present invention relates to a chair backrest. In particular, the present invention relates to a chair-backrest with improved stability, improved sitting comfort, and improved safety.

2. Description of the Related Art

FIGS. 5 and 6 of the drawings illustrate a conventional chair including a backrest 1', a seat 2', a chassis 3', a leg assembly 4', and a connecting plate 5'. 2he backrest 1' includes an engaging portion 11' with fixing holes 12' on a lower central portion thereof for connection with the connecting plate 5'. The chassis 3' is fixed to a central portion of an underside of the scat 2' and includes a lower end for connection with the leg assembly 4' and an engaging portion 31' with fixing holes 32' for connection with the connecting plate 5'. The connecting plate 5' is a substantially L-shaped plate including two plate sections having fixing holes 51' and 52' through which screws are extended for connecting the backrest 1' and the seat 2' in a perpendicular manner.

The backrest 1' is supported by the connecting plate 5' when the user is lying down. However, the supporting point provided by the connecting plate 5' is only at the lower central portion of the backrest 1' such that the forces exerted on the two sides of the backrest 1' are not uniform when center of gravity of the user's back shifts as a result of movement of the user. As a result, the connecting plate 5' could not provide a stable support when the user's back is not lying flat in the backrest 1'.

SUMMARY OF THE INVENTION

An object of the present invention is to provide a chair backrest with improved stability, improved sitting comfort, and improved safety.

A chair in accordance with the present invention includes a seat, a chassis fixed to an underside of the scat, a leg assembly attached to an underside of the chassis, a backrest, and a support frame. A plurality of engaging posts are formed on a peripheral portion of a rear side of the backrest, each engaging post having a groove, each engaging post further including a transverse fixing hole. The support frame extends along the peripheral portion of the rear side of the backrest A connecting beam includes a first end fixed to a lower portion of the support frame and a second end fixed to the chassis.

A plurality of connecting blocks are provided fixing the support frame to the rear side of the backrest. Each connecting block includes a sleeve portion through which the support frame extends. Each connecting block further includes an insertion portion engaged in the groove of the respective engaging post. The sleeve portion of each connecting block includes a slit allowing expansion of the sleeve portion when the support frame is extending through said connecting block. A fastener is extended through the transverse fixing hole in the respective engaging post into the insertion portion of the respective connecting block.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
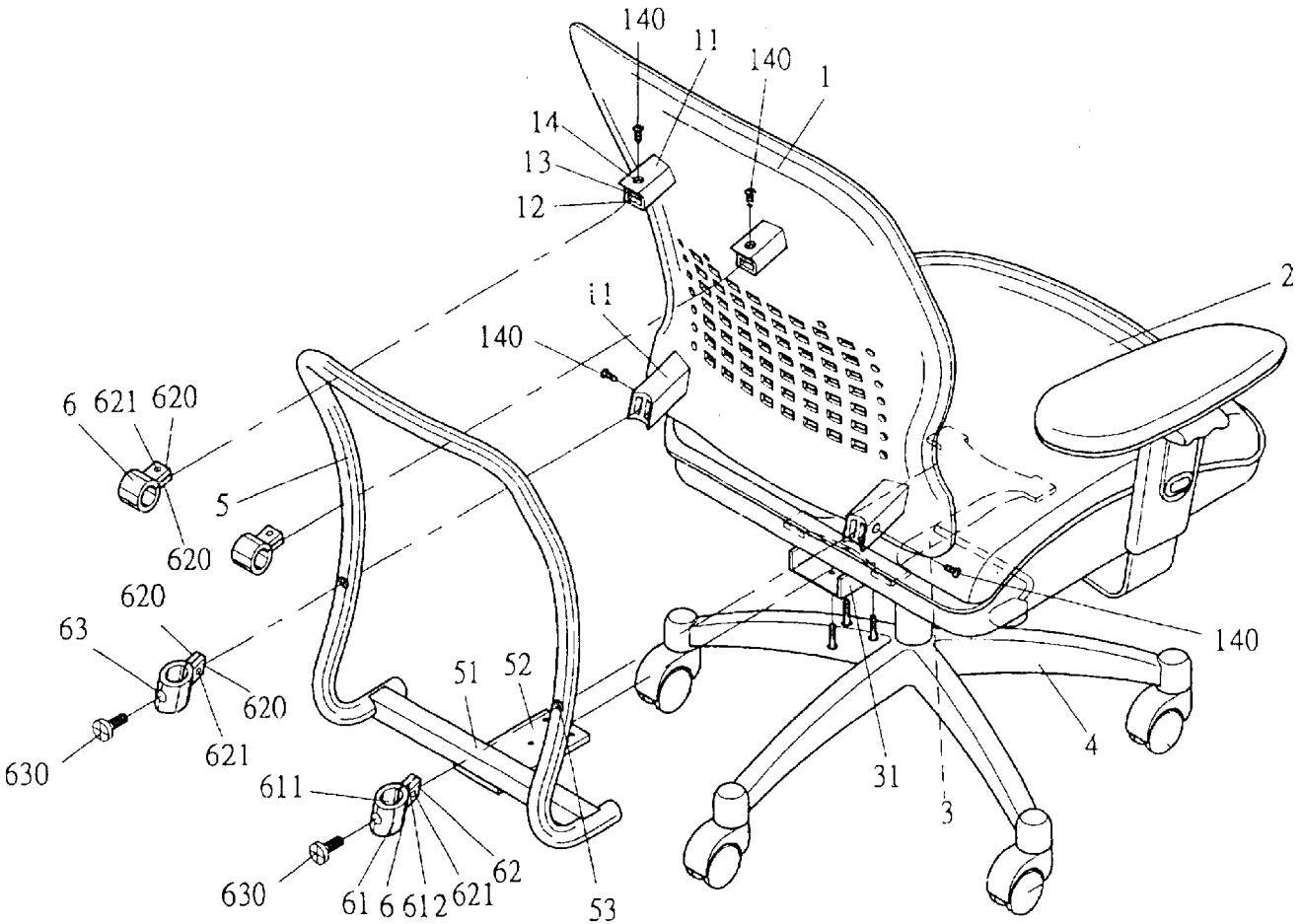
FIG. 1 is a perspective view, partly exploded, of a chair in accordance with the present invention.
Figure 2:
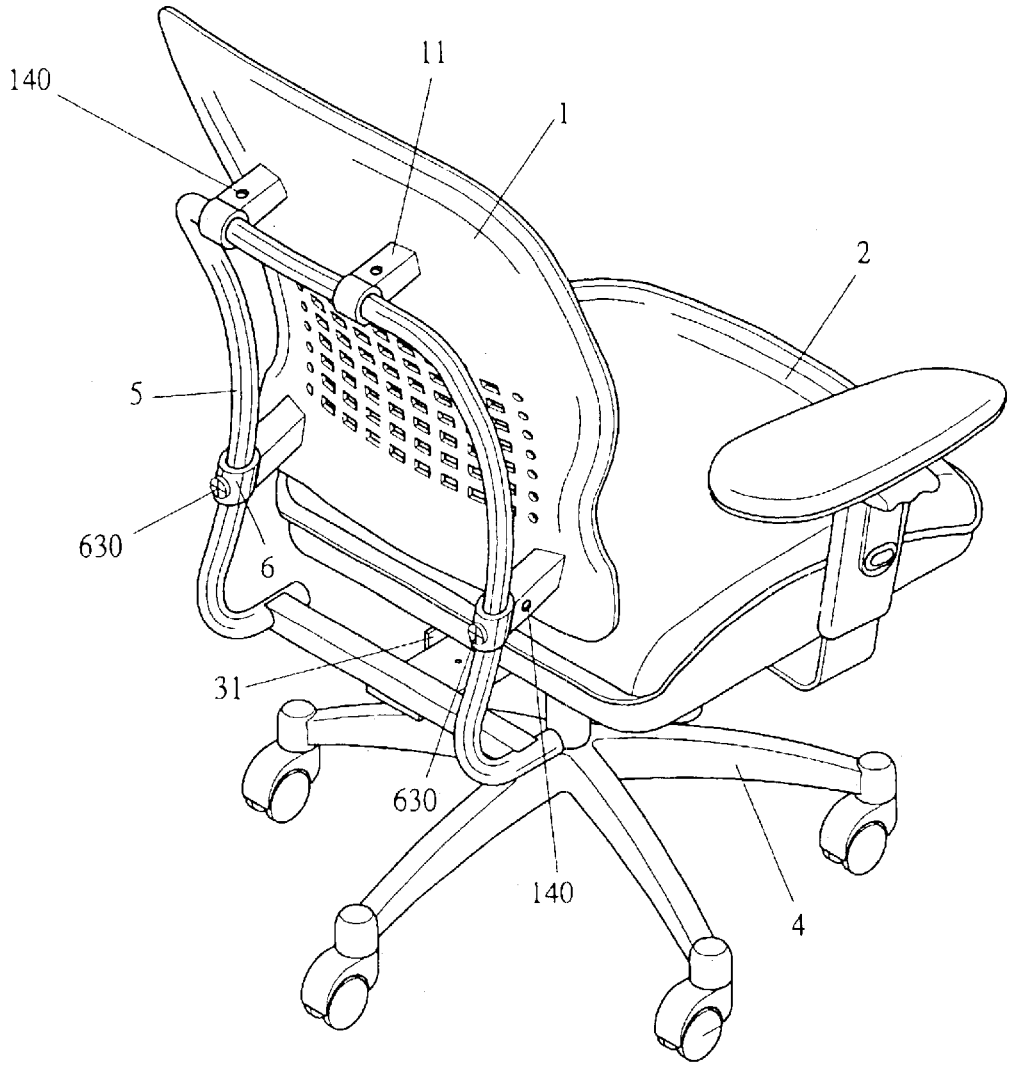
FIG. 2 is a perspective view of the chair in accordance with the present invention.

Referring to FIGS. 1 and 2, a chair in accordance with the present invention generally comprises a backrest 1, a seat 2, a chassis 3, a leg assembly 4, a support frame 5, and a plurality of connecting blocks 6. The backrest 1 includes a plurality of engaging posts 11 on a rear side thereof, each engaging post 11 having a groove 12 in a central portion thereof into which an insertion portion 62 of a respective connecting block 6 is inserted. A spacing member 13 is mounted in the groove 12 of the respective engaging post 11, and a transverse fixing hole 14 extends in a transverse direction of the respective engaging post 11. Preferably, the engaging posts 11 are provided on a peripheral portion of the rear side of the backrest 1.

The support frame 5 is mounted to the peripheral portion of the rear side of the backrest 1. In this embodiment, the support frame 5 is a substantially inverted U-shaped member having two substantially L-shaped limbs. A connecting beam 51 is fixed by, e.g., soldering to a lower portion of the support frame 5. The connecting beam 51 includes an engaging portion 52 (in the form of an extension plate extending from a central portion of the connecting beam 51 in this embodiment) for connection with a rear end of he chassis 3. The support frame 5 further includes a fixing hole 53 in each of two sides thereof.

Figure 3:
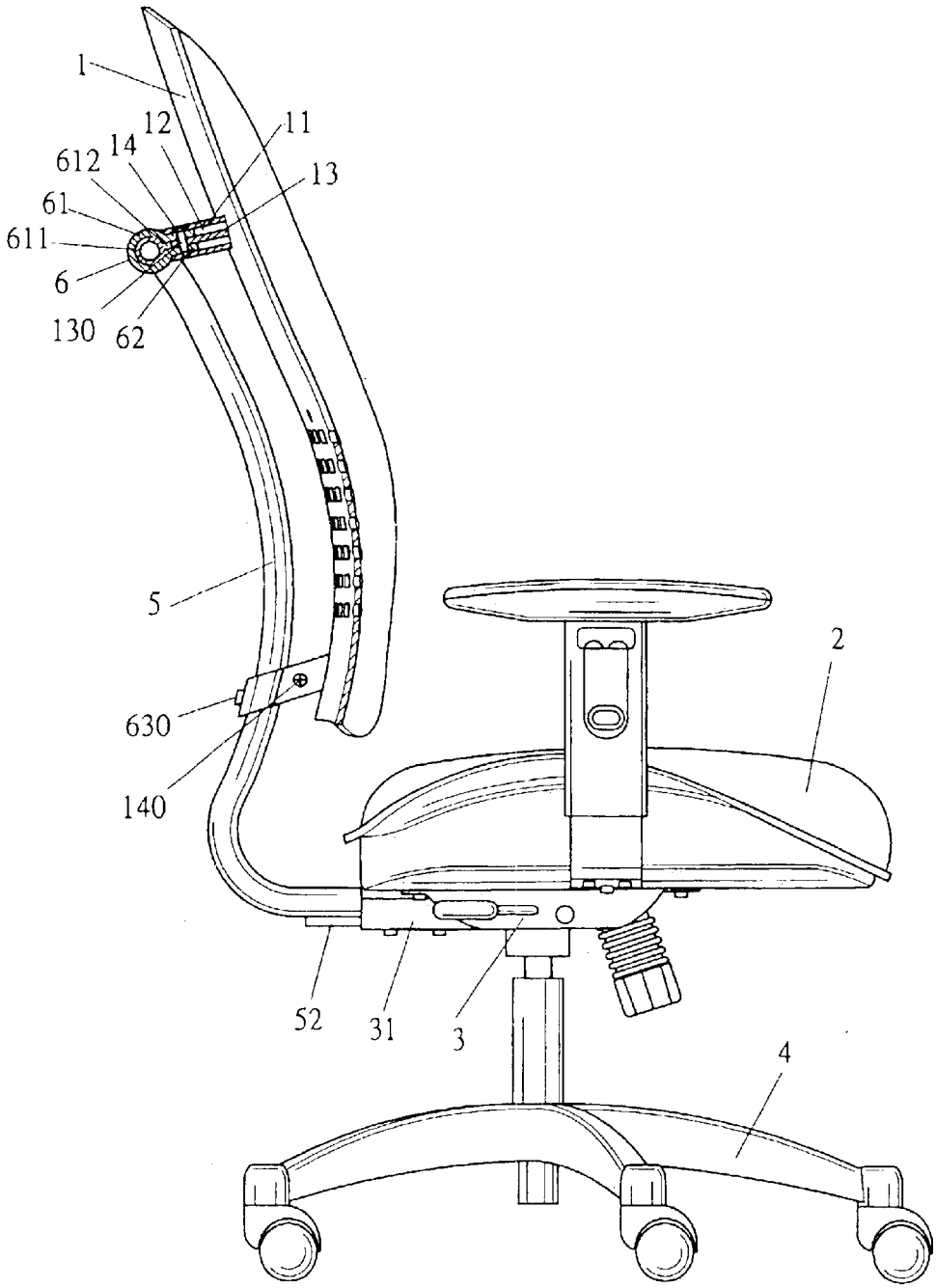
FIG. 3 is a side view, partly sectioned, of the chair in accordance with the present invention.
Figure 4:
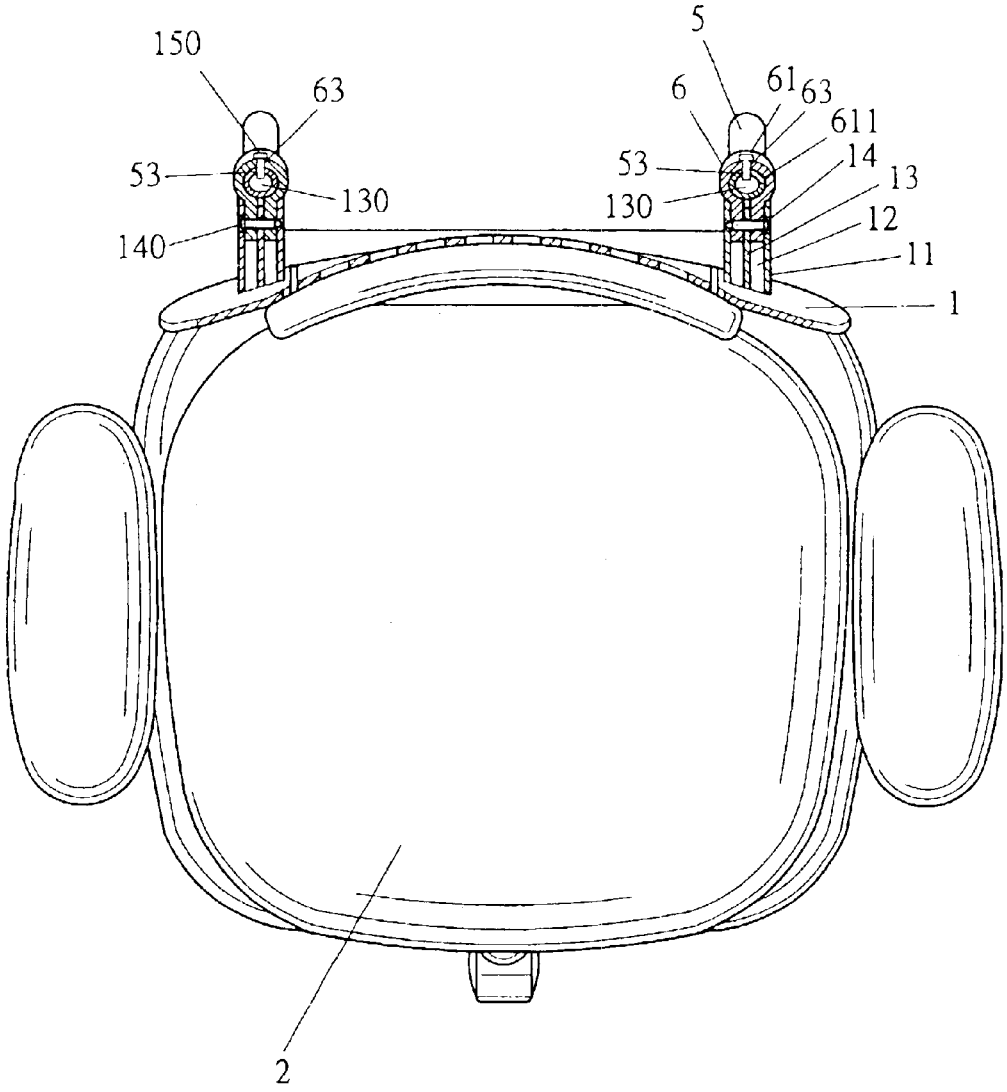
FIG. 4 is a top view, partly sectioned, of the chair in accordance with the present invention.
Figure 5:
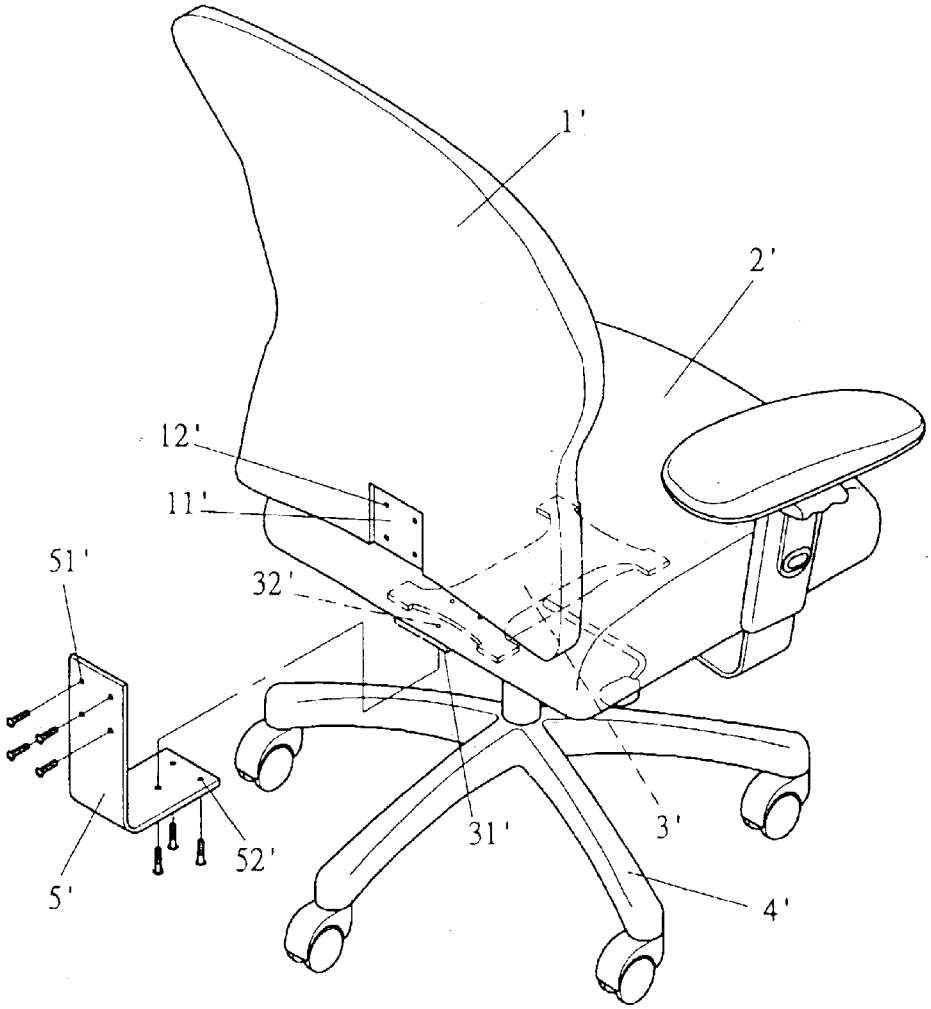
F I G . 5(PRIOR ART)
FIG. 5 is a perspective view, partly exploded, of a conventional chair.
Figure 6:
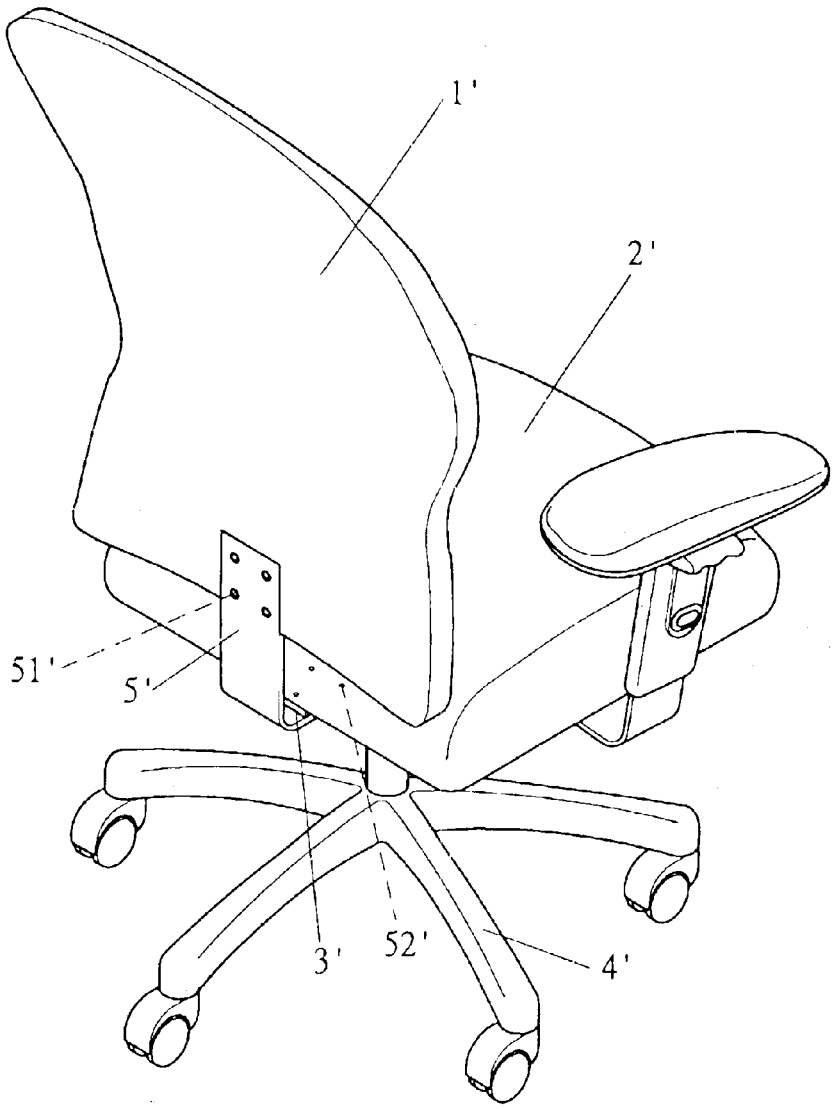
F I G . 6(PRIOR ART)
FIG. 6 is a perspective view of the conventional chair.

Each connecting block 6 includes a sleeve portion 61 in an end thereof and an insertion portion 62 on the other end thereof. In this embodiment, the sleeve portion 61 is a substantially C-shaped member with a gap or slit 612 defined between two adjacent ends of the C-shaped member. The C-shaped member has a longitudinal through-hole 611 through which the support frame 5 extends. The insertion portion 62 includes two insertion plates 620 respectively projecting radially outward from the two ends of the C-shaped member and having aligned holes 621. The insertion portion 62 is inserted into the groove 12 of the respective engaging post 11, and a fastener 140 (e.g., a self-tapping screw) is extended through the fixing hole 14 of the respective engaging post 11, the holes 621 of the insertion plates 620, and a hole 130 in the respective spacing member 13, best shown in FIG. 3. It is noted that the insertion plates 620 are located on two sides of the spacing member 13. Each connecting block 6 on the two sides of the backrest 1 includes a transverse hole 63. After connection with the support frame 5, a respective fastener 630 is extended through the respective transverse hole 63 and the respective fixing hole 53 of the support frame 5.

Referring to FIGS. 1 through 4, in assembly, the slit 612 of the respective connecting block 6 allows expansion of the respective connecting block 6 so as to be mounted around the support frame 5. Further, the insertion portion 62 of the respective connecting block 6 is engaged with the respective engaging post 11. Thus, the support frame 5 would not be loosened, as the upper end and the sides of the support frame 5 are engaged with the connecting blocks 6. The lower portion of the support frame 5 is fixed to the chassis 3 via the connecting beam 51. Thus, the lying force exerted by the user to the backrest 1 is supported by the loop-like support frame 5. The support stability and safety are both improved.

It is noted that engaging posts or protrusions (not shown) can be directly formed on the rear side of the support frame 5 for engaging with the engaging posts 11. In this case, the engaging blocks 6 can be omitted.

Although the invention has been explained in relation to its preferred embodiment, it is to be understood that many other possible modifications and variations can be made without departing from the scope of the invention as hereinafter claimed.

What is claimed is:

1. A chair comprising:

a seat;

a chassis fixed to an underside of the seat;

a leg assembly attached to an underside of the chassis;

a backrest, a plurality of engaging posts being formed on a peripheral portion of a rear side of the backrest, each said engaging post having a groove, each said engaging post further including a transverse fixing hole;

a support frame extending along the peripheral portion of the rear side of the backrest, a connecting beam including a first end fixed to a lower portion of the support frame and a second end fixed to the chassis; and a plurality of connecting blocks each including a sleeve portion through which the support frame extends, each said connecting block further including an insertion portion engaged in the groove of the respective engaging post, the sleeve portion of each said connecting block including a slit allowing expansion of the sleeve portion when the support frame is extending through said connecting block, a fastener being extended through the transverse fixing hole in the respective engaging post into the insertion portion of the respective connecting block, thereby fixing the support frame to the rear side of the backrest.

2. The chair as claimed in claim 1, wherein the support frame includes two sides each having a fixing hole, the respective connecting block including a transverse hole, with a further fastener extending through the transverse hole of the respective connecting block and the respective fixing hole of the support frame.

3. The chair as claimed in claim 1, wherein each said engaging post has a spacing member formed in the groove thereof, the spacing member having a hole, each said connecting block being a substantially C-shaped member having two ends adjacent to each other, the insertion portion of each said connecting block including two insertion plates respectively projecting radially outward from the ends of the substantially C-shaped member, the insertion plates having aligned holes, the spacing member of the respective engaging post being sandwiched between the insertion plates of the respective connecting block, with the respective fastener being extended through the transverse fixing hole in the respective engaging post, the aligned holes of the insertion plates of the respective connecting block, and the hole of the spacing member of the respective engaging post.

* * * * *